United States Patent [19]

Klubitschko

[11] 4,366,968

[45] Jan. 4, 1983

[54] COMBINATION SKI BOOT RETAINER AND SKI BRAKE

[75] Inventor: Gerd Klubitschko, Oberau, Fed. Rep. of Germany

[73] Assignee: Hannes Marker, Garmisch-Partenkirchen, Fed. Rep. of Germany

[21] Appl. No.: 198,133

[22] PCT Filed: Feb. 8, 1980

[86] PCT No.: PCT/DE80/00014

§ 371 Date: Oct. 21, 1980

§ 102(e) Date: Oct. 21, 1980

[87] PCT Pub. No.: WO80/01760

PCT Pub. Date: Sep. 4, 1980

[30] Foreign Application Priority Data

Feb. 21, 1979 [DE] Fed. Rep. of Germany ..... 2906726

[51] Int. Cl.[3] ..... A63C 7/10

[52] U.S. Cl. ..... 280/605; 280/628

[58] Field of Search ..... 280/604, 605, 623, 626, 280/628, 629

[56] References Cited

U.S. PATENT DOCUMENTS 3,917,297 11/1975 Früh ..... 280/605

4,035,001 7/1977 Jungkind ..... 280/626

4,098,110 7/1978 Bowden ..... 73/300

4,227,714 10/1980 Riedel ..... 280/605

4,234,206 11/1980 Hofbauer et al. ..... 280/605

FOREIGN PATENT DOCUMENTS 2613085 9/1977 Fed. Rep. of Germany ..... 280/605

*Primary Examiner*—Joseph F. Peters, Jr.

*Assistant Examiner*—Michael Mar

*Attorney, Agent, or Firm*—Squire, Sanders & Dempsey

[57] ABSTRACT

A ski stop is associated with a heel tightener for safety ski bindings that comprises a boot heel-supporting turntable to which there are pivotably secured two pull members, one passing each side of the boot heel, which carry a sole retainer movable against the force of at least one spring. To permit stepping into the binding without prior manipulation and automatically bring the ski stop to a position ready for operation, a base plate fixed to the ski and carrying the turntable has a horizontal cross-shaft to which there is pivoted a pedal of the ski stop that is pivotable against the force of at least one spring to a position above the turntable at least approximately parallel to the base plate. At least one lever in the form of a braking skid is hinged to the pedal parallel to its pivotal shaft and the arm of the lever is guided for longitudinal movement in an eyelet on the ski.

11 Claims, 3 Drawing Figures

COMBINATION SKI BOOT RETAINER AND SKI BRAKE

The present invention relates to a heel tightener for safety ski bindings comprising a boot heel-supporting turntable to which there are pivotally secured two pull members, one passing each side of the boot heel, which carry a sole retainer movable against the force of at least one spring, the heel tightener being associated with a ski stop.

Particularly the ski stop for such a heel tightener is shown in U.S. Pat. No. 3,917,297, whereas a heel tightener of the aforementioned kind, but without a ski stop, is for example described and illustrated in U.S. Pat. No. 4,035,001.

In the construction of U.S. Pat. No. 3,917,297, the ski stop is secured to the turntable. It comprises a braking plate which is hinged to and turns with the turntable and, for the purpose of braking the ski, is moved downwardly laterally past the ski under spring force. The braking plate is arranged in the front and/or rear region of the turntable. Swinging out of the turntable simultaneously permits the ski stop to become effective. In order that this may also be so upon release by a purely frontal fall, means are provided which, in the absence of the ski boot, turn the turntable laterally. When stepping into the binding, the turntable must be fixed and a slidable lock serves this purpose.

This construction is not only comparatively expensive and cumbersome to manipulate but also not certain to function because, after stepping into the binding, it is necessary to bring the slidable lock into its releasing position and if this is forgotten functioning of the ski stop is impossible upon release of the binding. For this reason, heel tighteners having such a ski stop have not proved practicable.

It is the object of the present invention to form and construct a heel tightener of the aforementioned kind such that it permits stepping into the binding particularly without prior manipulation and so that the ski stop automatically becomes ready for functional operation and will not detrimentally influence the function of the safety ski binding.

According to the invention, this is achieved by the characterising features of claim 1.

In a constructional embodiment of the invention, the lever may consist of an at least approximately L-shaped round wire of which the short limb forms the lever pivot engaging in the free end of the pedal that is formed as a bearing eye. This results in an economical embodiment which is simple to produce.

Desirably, the pivot shaft of the pedal is disposed between the turntable and the end of the ski. In this way one ensures that the braking skid will extend rearwardly, i.e. towards the end of the ski or at an acute angle thereto.

In a further development of this inventive concept, the pedal may have a locking arm extending beyond its pivot shaft. This locking arm serves to locate the pull elements and sole retainer on the ski when the ski boot is absent from the binding, which is particularly advantageous when transporting the ski. Preferably, the locking arm is in the form of a U-shaped wire frame and has its limbs longitudinally adjustably held on the pedal, which may even be necessary in those cases where the heel tightener of the invention but without a ski stop is only subsequently to be equipped with the ski stop.

If the pivot shaft of the pull members on the turntable is a central one or approximates to being central, the guide eyelet of the lever is preferably provided on the turntable.

A particularly simple construction is obtained if the spring is a coiled bending spring of which one limb acts on the pedal whereas the other limb serves as the base plate, and if the convolutions form the bearing for the pivot shaft.

In a development of the invention, the free end of the lever serving as a braking skid is cranked upwardly in respect to its inoperative position, thereby providing the advantage that, when the boot is inserted in the binding but the heel tightener is not yet closed, the latter is lifted by the cranked portion and can therefore be more easily closed.

Desirably, there are two levers so that, as is nowadays generally conventional for ski stops, there will be one braking skid on each side of the ski. In this case both levers can be formed from an at least approximately U-shaped round wire of which the web forms the common lever shaft.

One example of the invention will now be described with reference to the accompanying drawings, wherein.

Figure 1:
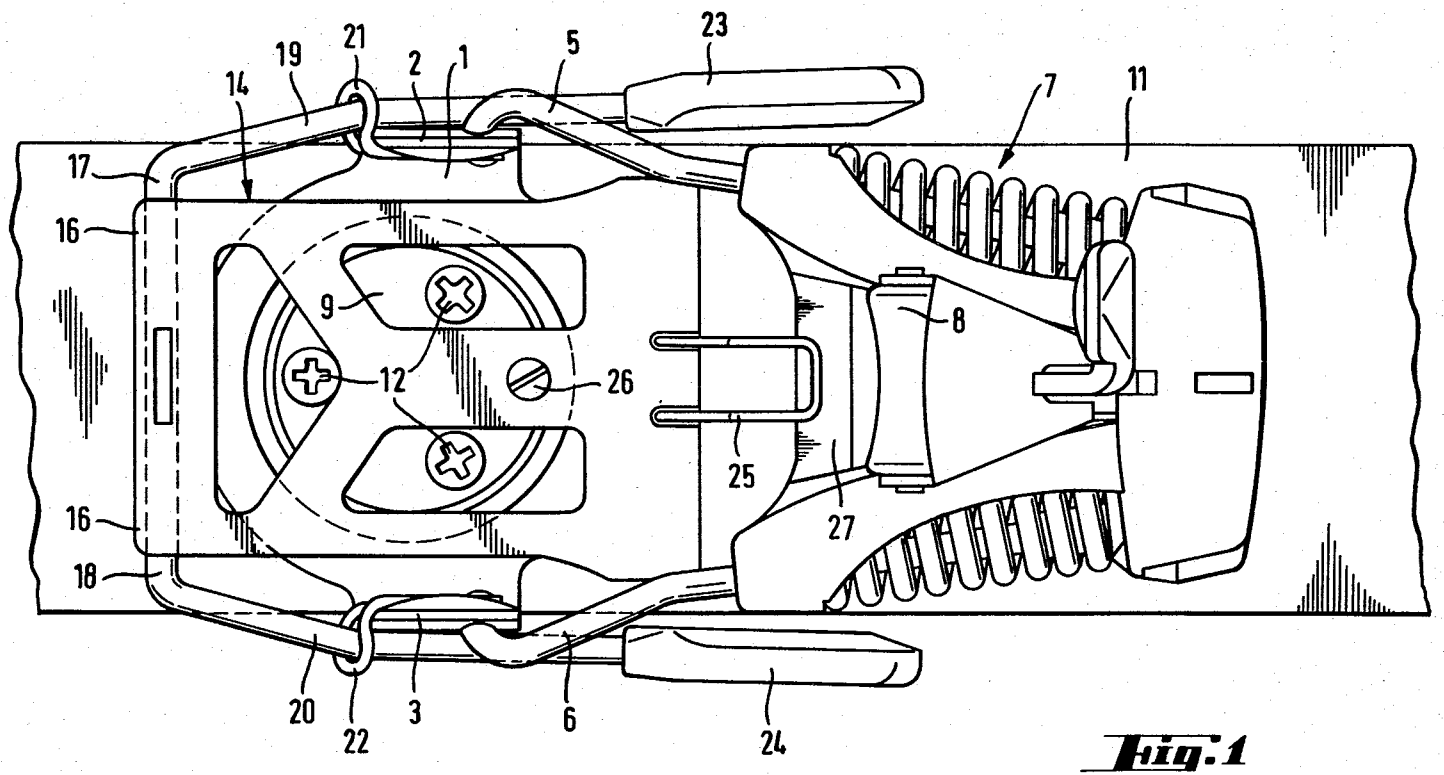
FIG. 1 is a plan view of the heel tightener in the open condition.

The heel tightener for safety ski bindings as shown in the drawings comprises a turntable 1 having upwardly flanged side cheeks 2, 3. A pull rod 5 or 6 is hung into a hole 4 of each side cheek. The two pull rods, which extend past the sides of the heel when the ski boot is inserted in the binding, are interconnected by means of an advancing element 7. The advancing element, which is substantially U-shaped in plan (see FIG. 1), carries a pivotable sole retainer 8 between its limbs. A further detailed description of the heel tightener is being dispensed with here because it is only an example and its other details are irrelevant to the present invention. The construction and function of this heel tightener can be seen from U.S. Pat. No. 4,035,001.

Figure 2:
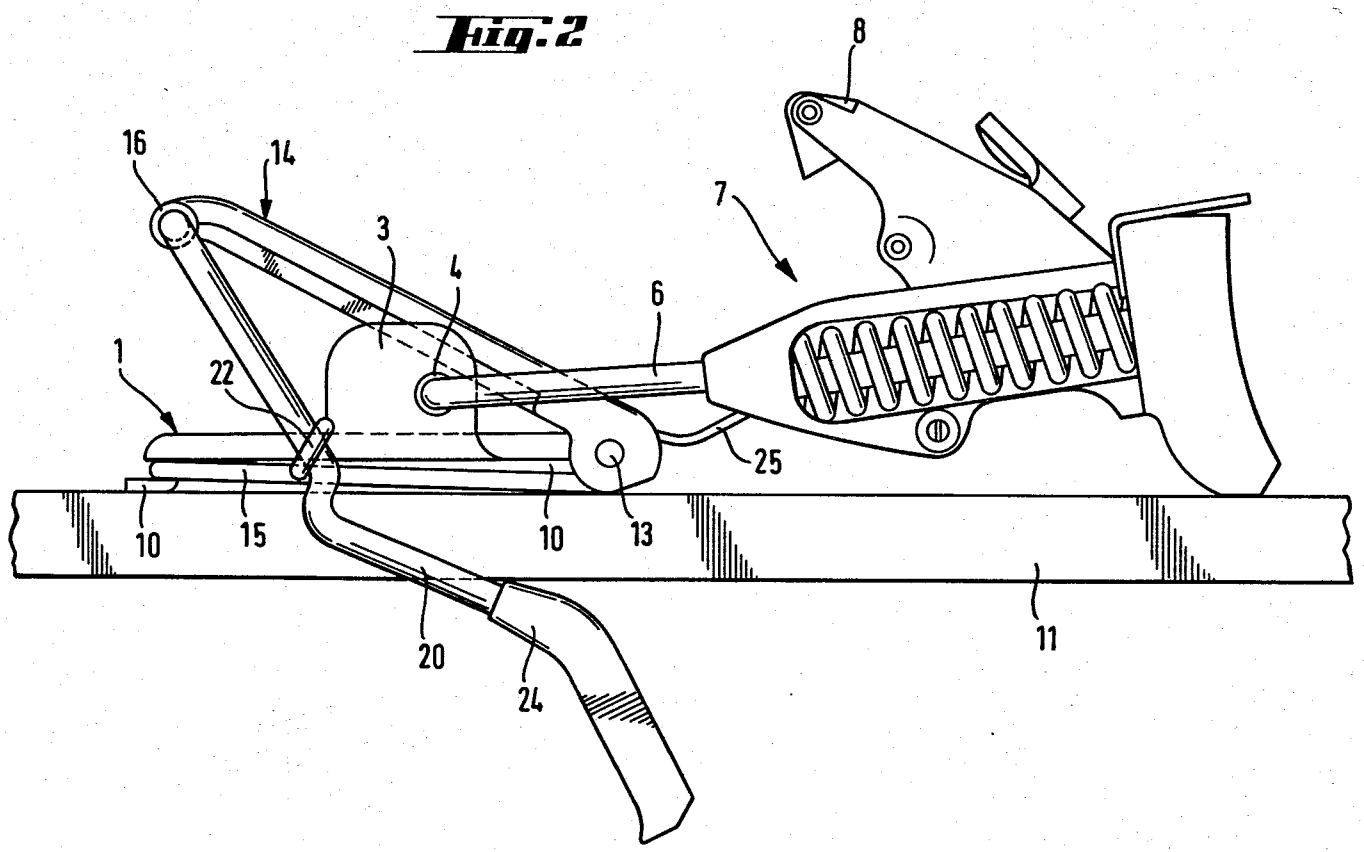
FIG. 2 is a side elevation of the FIG. 1 heel tightener.

By means of a retaining plate 9 (FIG. 1), the turntable 1 is held to a ski 11 by means of three screws 12 with an interposed base plate 10 (FIG. 2). The base plate has a horizontal cross-shaft 13 to which a pedal 14 of a ski stop is hinged. This pedal is under the influence of a coiled bending spring (not shown in detail), which is mounted on the cross-shaft 13 and one limb 15 of which is supported by the ski by way of the base plate whereas the other limb (not shown) holds the pedal in its FIG. 2 position.

The pedal 14 extends over the turntable from the cross-shaft 13 which is disposed on the side of the turntable 1 facing the end of the ski. The free end of the pedal is in the form of a bearing eye 16. Engaged in this bearing eye from both sides there are the short limbs 17 or 18 of a respective substantially L-shaped round wire, these short limbs serving as pivotal shafts for the long limbs 19, 20 which form braking skids. Each long limb is longitudinally displaceable in an eyelet 21 or 22 which is formed from round wire and anchored at the turntable 1. The free ends of the long limbs 19, 20 are cranked upwardly with respect to the inoperative position of the ski stop of FIG. 3. In a manner known for ski stops, they carry a plastics covering 23 or 24. The purpose of the cranked formation will be described later.

The pedal 14 has a locking arm extending beyond the pivotal shaft 13 and formed as a U-shaped wire frame 25 (FIG. 1). Its limbs are releasably held to the pedal by means of a clamping screw 26 so that the length of the locking arms is adjustable. In the open condition of the heel tightener corresponding to FIGS. 1 and 2, the locking arm 25 engages over a web 27 between the two limbs of the advancing element 7 and resiliently pushes the latter against the surface of the ski 11.

Figure 3:
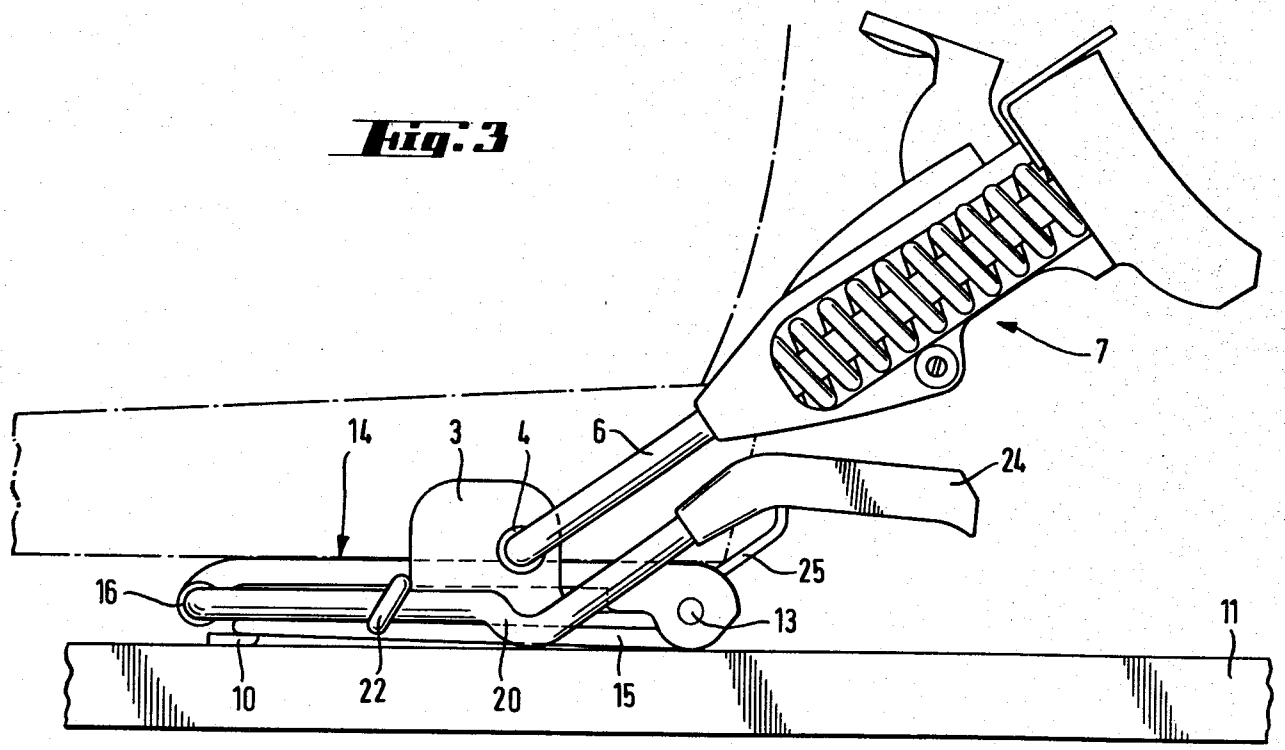
FIG. 3 is a view similar to FIG. 2 but in the closed condition of the heel tightener.

Starting from the position of FIGS. 1 and 2, closing of the heel tightener takes place after introducing the tip of the ski boot into the front jaw (not shown) which, together with the heel tightener, forms the safety ski binding, and after lowering of the rear end of the ski boot (shown in chain dotted lines in FIG. 3) onto the pedal 14, and after pivoting the pedal against the force of the coiled bending spring into a position parallel to the base plate 10 by lifting the heel tightener and inserting the sole retainer 8 into the groove in the heel of the ski boot, and by subsequently pulling the heel tightener upwardly at its rear end until a lock of the sole retainer snaps shut. This condition of the closed heel tightener and of the ski stop which is now in a position ready for operation is shown in FIG. 3. During lowering of the pedal 14, the locking arm 25 is released from the web 27 of the advancing element 7. By means of the cranking of the long limbs 19, 20 serving as braking skids, one ensures that, with the pedal 14 depressed, the advancing element 7 with pull rods 5, 6 is somewhat lifted from the plastics coverings 23, 24 so that it can be grasped more easily.

The width of the pedal 14 extending over the turntable 1 is such that it will not impede turning of the turntable when the front jaw is released laterally. After the tip of the boot is freed from the front jaw, i.e. upon release during a rotational fall, the rear end of the ski boot is automatically freed from the sole retainer 8 and thus also the ski boot from the ski 11. The coiled bending spring can thereby swing the pedal 14 upwardly and thus bring the long limbs 19, 20 into the braking position of FIG. 2. During frontal and diagonal forward overloading, the ski boot is released to bring the ski stop into operation after releasing the lock of the sole retainer 8.

The ski stop assumes its braking position after intentional as well as unintentional release of the ski boot from the ski 11. If the advancing element 7 with sole retainer 8 is to be held onto the ski when there is no ski boot in the binding, the locking arm 15 has to be brought into engagement with the web 27 of the advancing element. This is achieved simply by depressing the pedal 14 and subsequently releasing it again with the advancing element lying against the ski.

I claim:

1. A ski binding for releasably attaching a ski boot to a ski, said binding having an open condition when no ski boot is mounted in the binding and a closed condition when a ski boot is mounted in the binding, said binding comprising:

a base fixed to the top of said ski;

a turntable mounted over said base, said turntable being rotatable relative to said base and having guide means thereon;

a ski boot retainer mounted to said turntable for releasably holding a ski boot;

a pedal pivotably attached to said base and positioned over said turntable, said pedal being movable between a position adjacent said base and a position away from said base;

biasing means for biasing said pedal away from said base;

at least one brake arm comprising a first limb hinged to said pedal, a second limb having a free braking end and being pivotable upwardly into a skiing position above the bottom of said ski when said pedal is urged toward said base by a ski boot held by said ski boot retainer and being pivotable downwardly into a braking position below the bottom of said ski by said braking means urging said pedal away from said base when said ski boot is released from said pedal;

said guide means of said turntable guiding said brake arm for sliding movement therethrough when said second limb moves between the skiing and braking positions.

2. The invention of claim 1, wherein said guide means includes an eyelet, and said second limb is slidably attached to said eyelet.

3. The invention according to claims 2 or 1 wherein said guide means includes a vertical cheek flange.

4. The invention of claim 1, or 2, further comprising a locking arm on said pedal for engaging said ski boot retainer and urging said ski boot retainer downward toward said ski when the ski binding is in the open condition.

5. The invention according to claim 1 wherein said pedal has a cross width narrow enough to enable some rotation of said turntable relative to said base.

6. The invention of claims 1, 2 or 5 wherein said at least one brake arm comprises a pair of brake arms disposed on opposite sides of said pedal.

7. The invention according to claim 1 wherein said at least one brake arm comprises a pair of brake arms disposed on opposite sides of said pedal, and the first limbs of said brake arms are transverse to the second limbs of the respective brake arms, and said first limbs form a common element.

8. The invention according to claim 1 wherein said base further comprises a cross shaft, and said pedal is pivotably mounted on said cross shaft for movement between positions adjacent to and away from said base.

9. The invention according to claim 8 wherein said first limb is rotatable in said pedal on an axis parallel to said cross shaft.

10. The invention according to claim 8 wherein said binding has a forward portion facing a ski tip when the binding is mounted on a ski, and said cross shaft is disposed forwardly of said turntable.

11. The invention according to claim 1 wherein said biasing means comprises a coil spring wound about a cross shaft, said spring having a first end biased against said pedal and a second end biased against said base, said ends urging said pedal and said base away from each other about said cross shaft.

* * * * *